US008397404B2

(12) United States Patent
Kim

(10) Patent No.: US 8,397,404 B2
(45) Date of Patent: Mar. 19, 2013

(54) HEALTH SHOES

(76) Inventor: Jung Bae Kim, Gyeongsangbuk-do (KR)

( * ) Notice: Subject to any disclaimer, the term of this patent is extended or adjusted under 35 U.S.C. 154(b) by 831 days.

(21) Appl. No.: 12/224,824

(22) PCT Filed: Mar. 5, 2007

(86) PCT No.: PCT/KR2007/001077
§ 371 (c)(1),
(2), (4) Date: Sep. 5, 2008

(87) PCT Pub. No.: WO2007/102680
PCT Pub. Date: Sep. 13, 2007

(65) Prior Publication Data

US 2009/0193687 A1 Aug. 6, 2009

(30) Foreign Application Priority Data

Mar. 7, 2006 (KR) ..... 20-2006-0006108 U

(51) Int. Cl.
*A63B 26/00* (2006.01)
*A63B 23/10* (2006.01)
*A43B 13/00* (2006.01)

(52) U.S. Cl. ..... 36/103; 36/132; 482/79; 482/123; D2/946

(58) Field of Classification Search ..... 36/103, 36/102, 27, 28, 29, 132, 136; D2/946; 482/77, 482/79, 75, 123, 146; D21/412; 472/135
See application file for complete search history.

(56) References Cited

U.S. PATENT DOCUMENTS

| | | | | | |
|---|---|---|---|---|---|
| 3,219,358 | A | * | 11/1965 | Hagner | 280/11.14 |
| 5,205,798 | A | * | 4/1993 | Lekhtman | 482/77 |
| 5,301,441 | A | * | 4/1994 | Kownacki | 36/7.8 |
| 5,643,148 | A | * | 7/1997 | Naville | 482/77 |
| 5,685,807 | A | * | 11/1997 | Tong et al. | 482/77 |
| 5,916,071 | A | * | 6/1999 | Lee | 482/77 |
| 6,318,001 | B1 | | 11/2001 | Lee | |
| 6,551,225 | B1 | * | 4/2003 | Romero | 482/146 |

FOREIGN PATENT DOCUMENTS

| | | |
|---|---|---|
| JP | 03015011 U | 8/1995 |
| KR | 96-3722 | 2/1996 |
| KR | 20-0348869 | 4/2004 |

OTHER PUBLICATIONS www.footsmart.com "Step Stretch", printed Sep. 4, 2008.

* cited by examiner

*Primary Examiner* — Jila M Mohandesi
(74) *Attorney, Agent, or Firm* — Kile Park Goekjian Reed & McManus PLLC

(57) ABSTRACT

The present invention relates to a health shoe having an arc type stretching body to be formed apart from a front end and a rear end of a shoe sole with a predetermined distance apart, which is capable of doing stretching exercises at the stable status because 5 the arc type stretching body is supported by the front end or the rear end in contact with the ground when doing exercises in forward flexion or backward extension postures.

6 Claims, 20 Drawing Sheets

HEALTH SHOES

TECHNICAL FIELD

The present invention relates to a health shoe, and more particularly, to a health shoe having an arc type stretching body to be formed apart from a front end and a rear end of a shoe sole with a predetermined distance, which is capable of performing stretching exercises at the stable status because the arc type stretching body is supported by the front end or the rear end in contact with the ground when doing exercises in forward flexion or backward extension postures.

BACKGROUND ART

In particular, the Achilles tendon which is a part extending from the calf muscle composed of gastrocnemius or calf functions suitably for walking depending on a pedestrian's actual needs by adjusting movements of the ankle joint according to relaxation and contraction of the muscle.

Such an Achilles tendon may be easily injured due to sudden shock or fatigue of the clay muscles in response to overstretching. Thus, it is preferably to relieve the tension in the Achilles tendon and the calf muscle after high impact sports such as a marathon.

It has been disclosed in Korean Utility Model No. 20-0409798 regarding a shoe for relieving the tension in the Achilles tendon and the calf muscle.

The conventional art is able to easily fall forward or backward when doing exercises in the forward flexion or backward extension postures because the entire sole of the shoe is formed in arc type. Furthermore, it is uneasy without stability when doing exercises for relieving the tension in the Achilles tendon and the clay muscle and exercise effects are also reduced because the user cannot keep a standing posture in the same position for a long time.

DISCLOSURE OF THE INVENTION

The present invention has been made to solve the above disadvantages and an object of the present invention is to provide a health shoe which can improve a stretching exercise effect in the stable posture because an arc type stretching body is supported by the front end or the rear end of the shoe sole in contact with the ground when doing exercises to relieve the tension in the Achilles tendon and the clay muscle.

To achieve the above object of the present invention, there is provided a health shoe having an arc type stretching body which is spaced apart from the front end and the rear end of a shoe sole with a predetermined distance and is integrally formed with the shoe sole, wherein the arc type stretching body, in which the circumference thereof is formed in an arc type along a length direction of the shoe, is supported by the front end or the rear end in contact with the ground when doing the forward flexion and backward extension postures through the arc type stretching body.

The arc type stretching body may further be separated from the shoe sole. The arc type stretching body is connected to the shoe sole by an eccentricity, so that the position of the stretching body may be moved forward and backward as much as the eccentric length at the shoe sole when the arc type stretching body which may be separated from the shoe sole is rotated through 180 degree around the shoe sole.

BRIEF DESCRIPTION OF THE DRAWINGS

The accompanying drawings illustrate preferred embodiments of the present invention. This invention may, however, be embodied in different forms and should not be construed as limited to the embodiments set forth in the drawings.

BEST MODE

Figure 1:
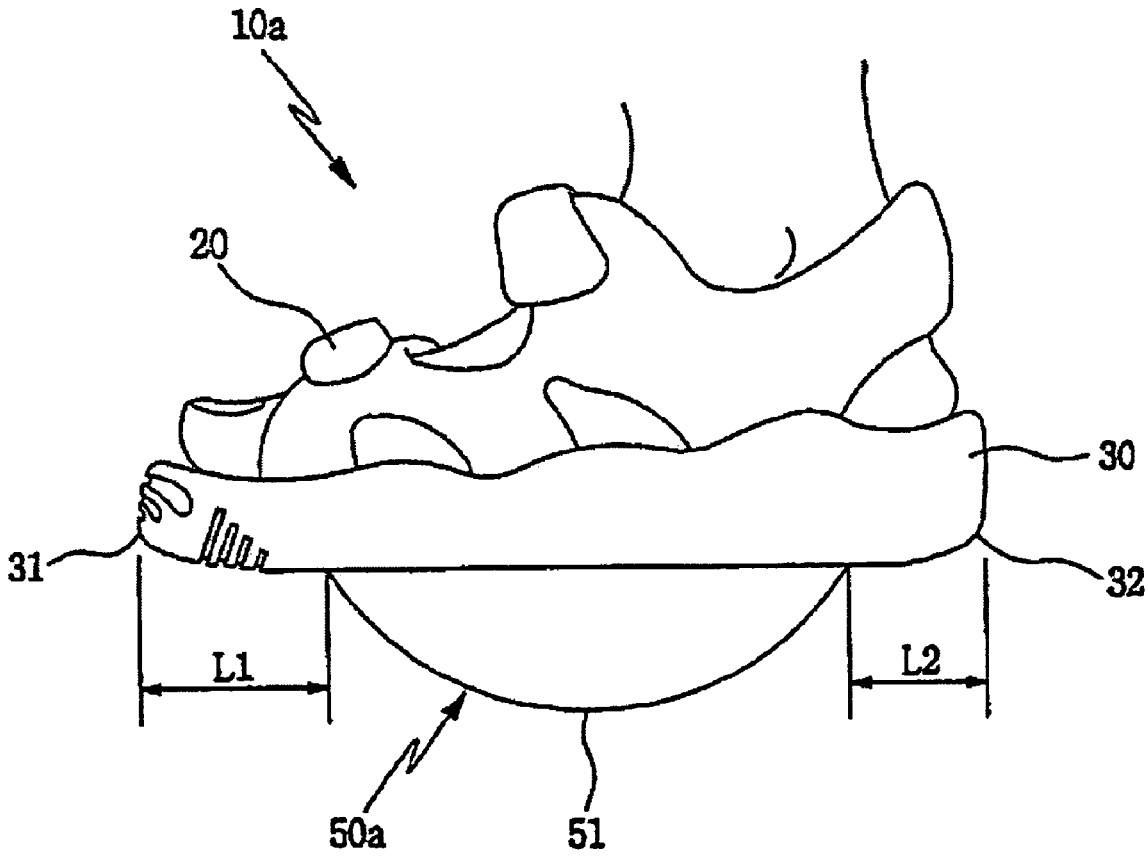
FIG. 1 is a side view of a health shoe according to a first exemplary embodiment of the present invention.

Preferred exemplary embodiments of the present invention will now be described in greater detail with reference to the accompanying drawings.

In the description to the reference numerals in various exemplary embodiments and modified embodiments of the present invention, the parts that is identical or similar among the embodiments will be hereinafter described in using the same reference numerals.

Figure 2:
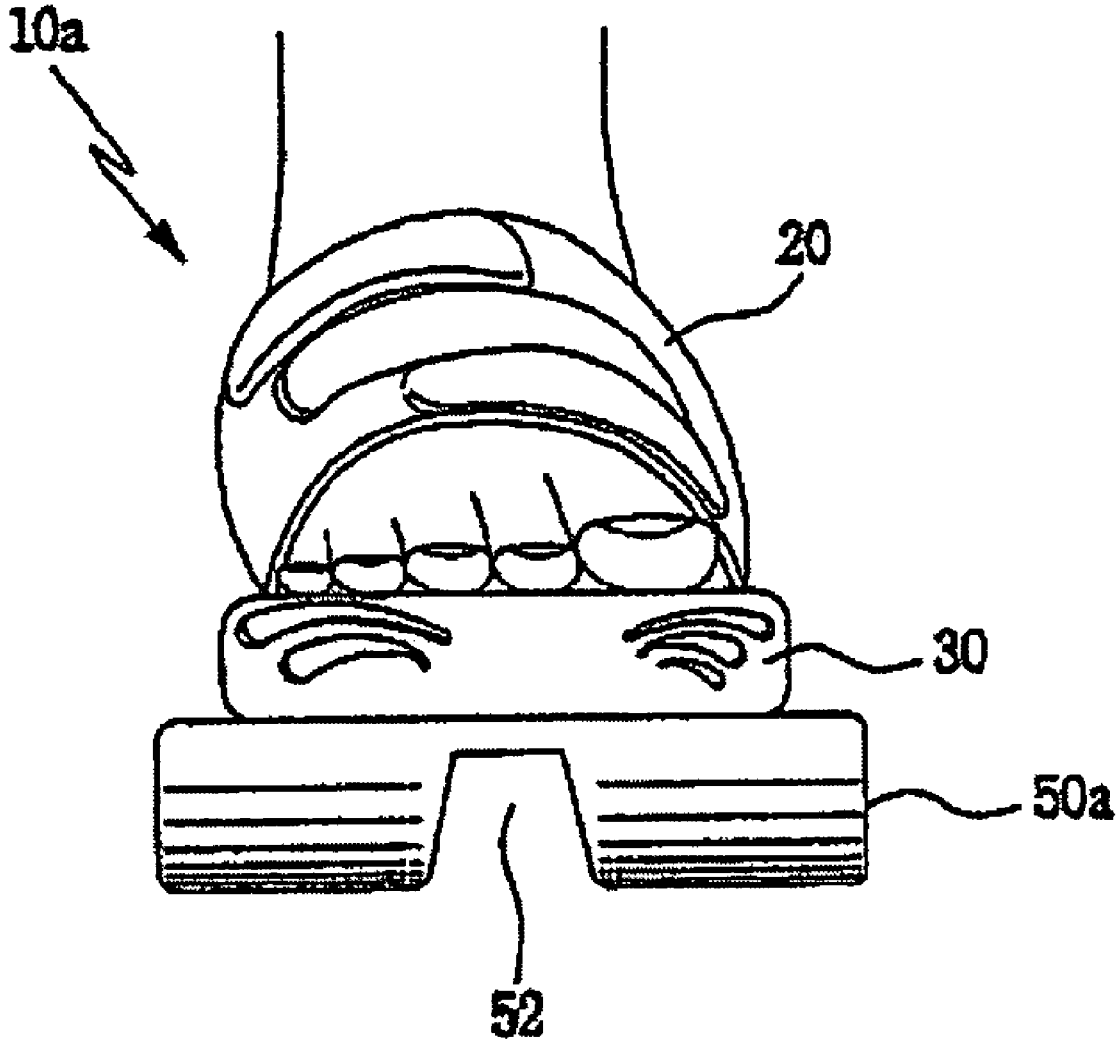
FIG. 2 is a front view of FIG. 1.

Referring to FIG. 1 and FIG. 2 which are side and front views of a health shoe according to a first exemplary embodiment of the present invention, the health shoe 10*a* is configured with an arc type stretching body 50*a* formed at a shoe sole 30.

The arc type stretching body 50*a* is formed apart from a front end 31 and a rear end 32 of the shoe sole 30 with predetermined distances L1, L2 and the circumference of the lower part 51 thereof is formed in an arc type along a length direction of the shoe 20.

The arc type stretching body 50*a* may be integrally formed with the shoe sole 30 and be further detachable from the shoe sole 30 in using attachment means.

The shoe 20 may be provided with various types such as general sport shoes or sandals and ordinary shoes used by the human and materials of the arc type stretching body 50*a* may use a synthesis resin having a little cushion as a rubber or a synthesis rubber and like that are the same as them of the shoe sole 30.

As shown in FIG. 2, the arc type stretching body 50*a* may reduce its weight by forming a space part 52 in which the center thereof is dented in the length direction.

Figure 3A:
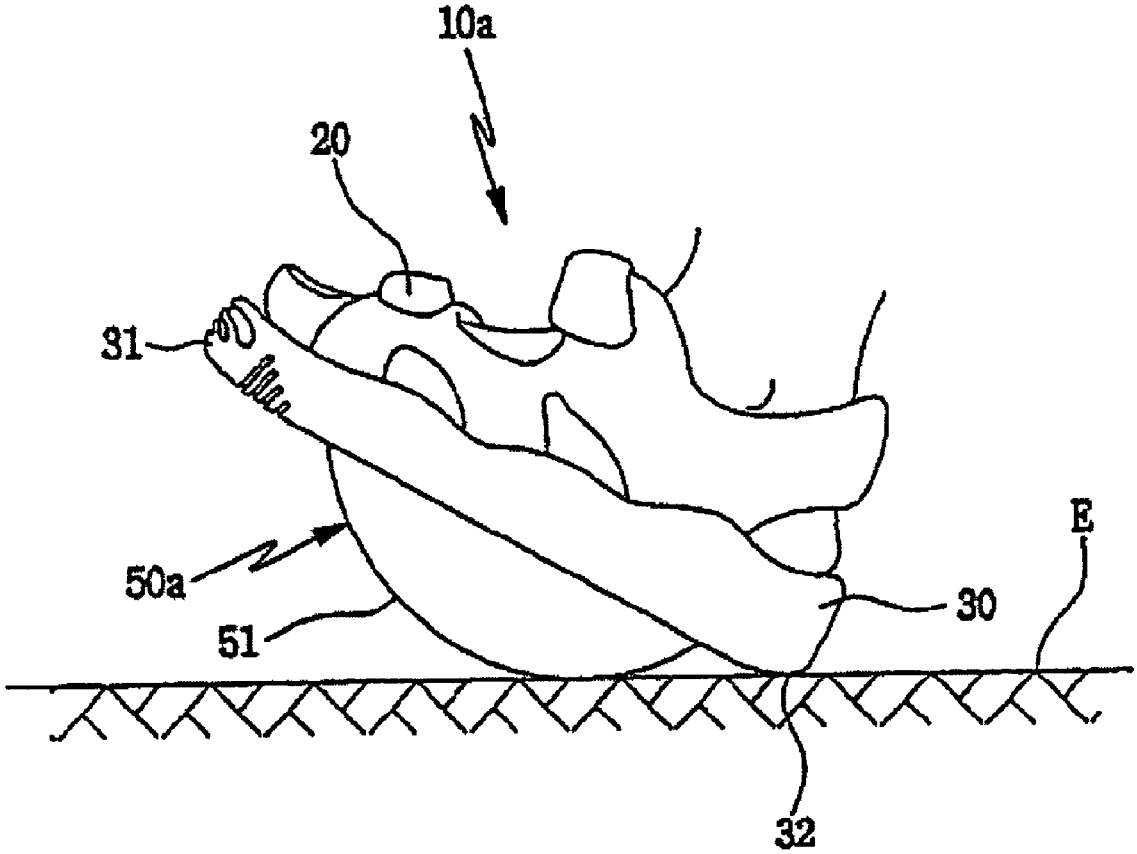
FIGS. 3A and 3B are views illustrating the operation status of the health shoe as shown in FIG. 1.

As shown in FIG. 3*a*, the user with the health-shoe 10*a* as constructed above can do stretching exercises in a backward extension posture by bending backward the health shoe 10*a*. This is, the arc type stretching body 50*a* is naturally bent backwardly by the rounded surface of the circumference 51 thereof and is supported by the rear end 32 of the shoe sole 30 in contact with the ground so that the user can keep the stable status.

Figure 3B:
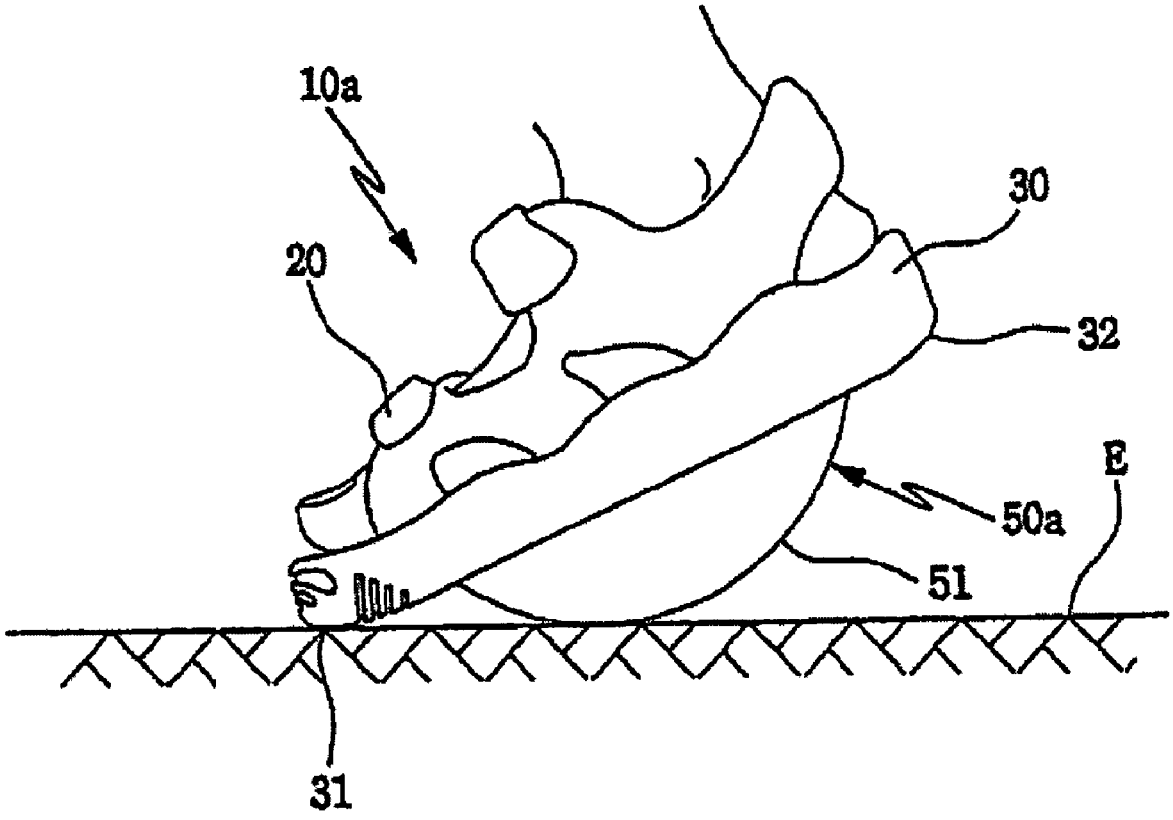

As shown in FIG. 3B, the stretching body 50*a* is naturally bent forwardly by the rounded surface of the circumstance 51 thereof when doing the forward flexion posture of the health shoe 10*a* and is supported by the front end 31 of the shoe sole 30 in contact with the ground so that the user can keep the stable status.

When the user with the health shoe does stretching exercises in the forward flexion and backward extension postures through the arc type stretching body 50*a*, the front end 31 and the rear end 32 of the shoe sole 30 allow to be supported in contact with the ground so that the user can do stretching exercises in the stable posture without falling forward or backward.

At this time, the stretching exercises may be done on walking or at the same place. Also, the user can do balance exercises if exercising on walking at the status such that the front end 31 and the rear end 32 are not in contact with the ground as shown in FIG. 1.

Figure 4A:
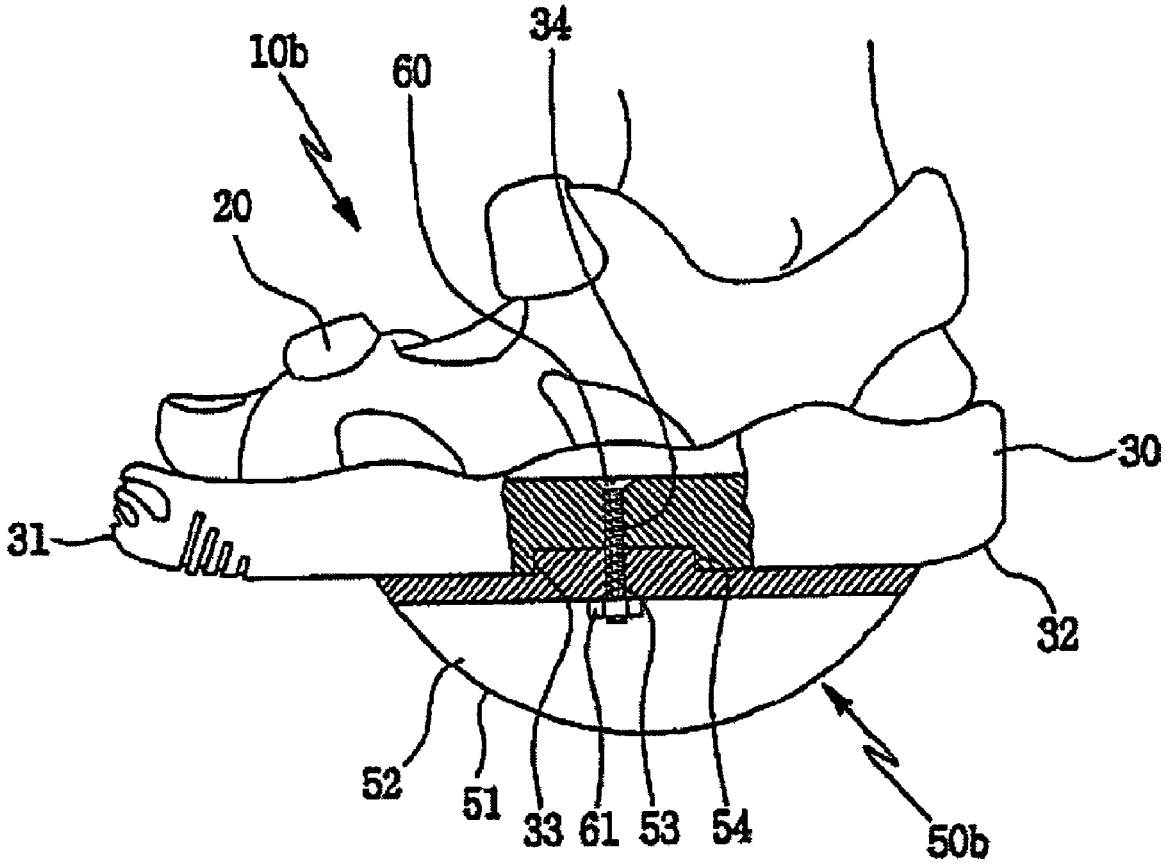
FIGS. 4A and 4B are partially cut side views of the health shoe according to a second exemplary embodiment of the present invention.
Figure 4B:
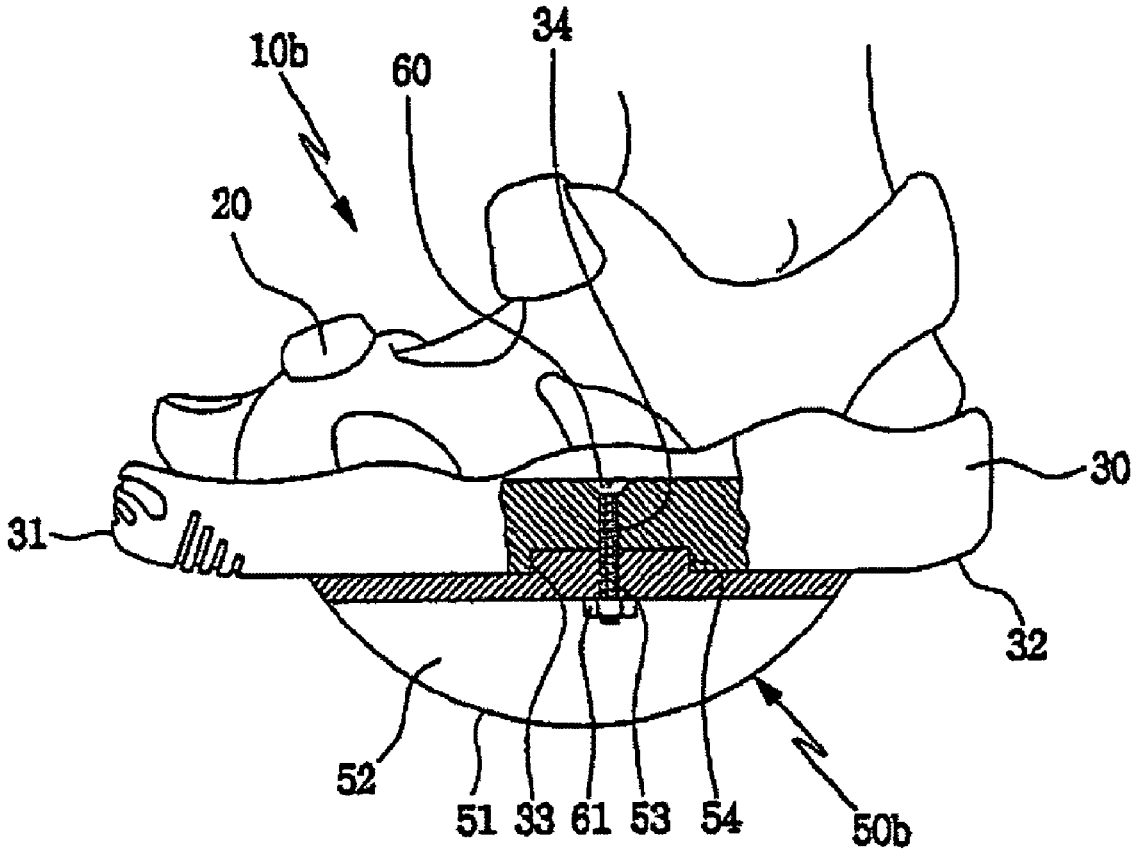

Referring to FIGS. 4A and 4B which are a second exemplary embodiment of a health shoe 10*b*, a arc type stretching body 50*b* be separated from the shoe sole 30.

An eccentric ball 53 is formed at the arc type stretching body 50*b*, a circle guide platform threshold 54 is formed around the eccentric ball 53, a circular guide groove 33 corresponding to the circle guide platform threshold 54 is formed at the shoe sole and an joint ball 34 is formed at the center of the circular guide groove 33, so that the arc type stretching body 50*b* may be separated from the shoe sole 30 with joint means such as a bolt 60 and a nut 61.

Figure 5A:
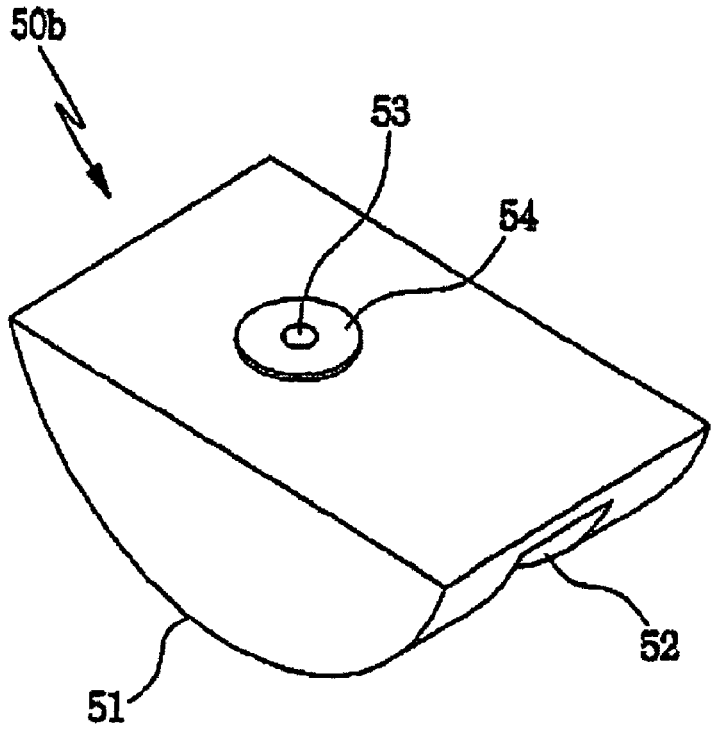
FIGS. 5A and 5B are perspective and plane views illustrating an arc type stretching body as shown in FIG. 4A.
Figure 5B:
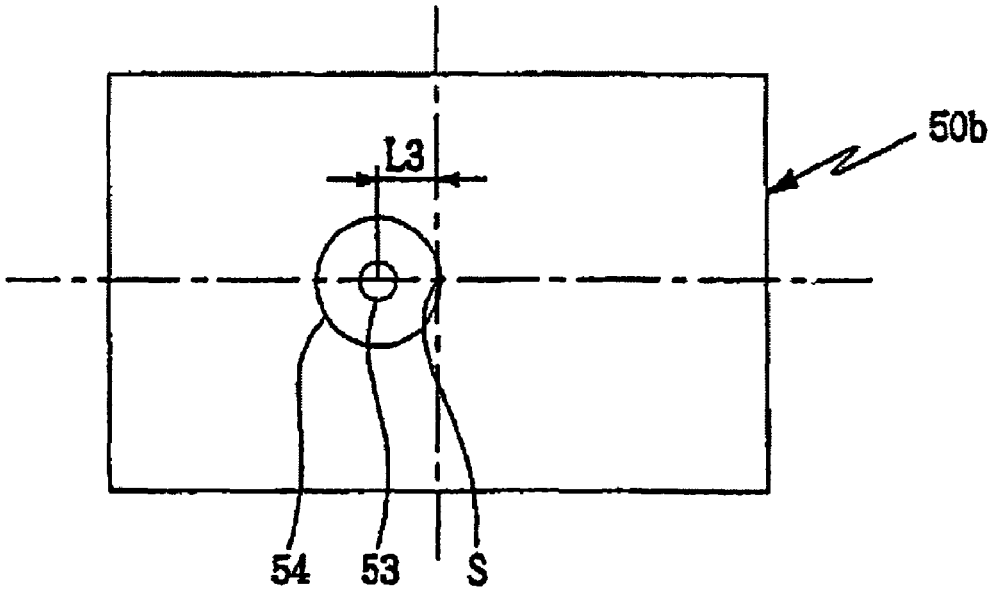

As shown in FIGS. 5A and 5B, the eccentric ball 53 is formed by moving the center of the arc type stretching body 50*b* to one side of the length direction, so that the arc type stretching body 50*b* may be moved forwardly and, backwardly at the shoe sole 30 as much as an eccentric length L3 in response to 180° rotation of the arc type stretching body 50*b*.

In the health shoe 10*b* as constructed above, when the arc type stretching body 50*b* is rotated through 180° at the status such that the arc type stretching body 50*b* is slightly bent backward at the shoe sole 30 as shown in FIG. 4A, the arc type stretching body 50*b* is moved toward the front side of the shoe sole 30 as much as the eccentric length L3 of the eccentric ball 53 as shown in FIG. 4B.

Figure 6A:
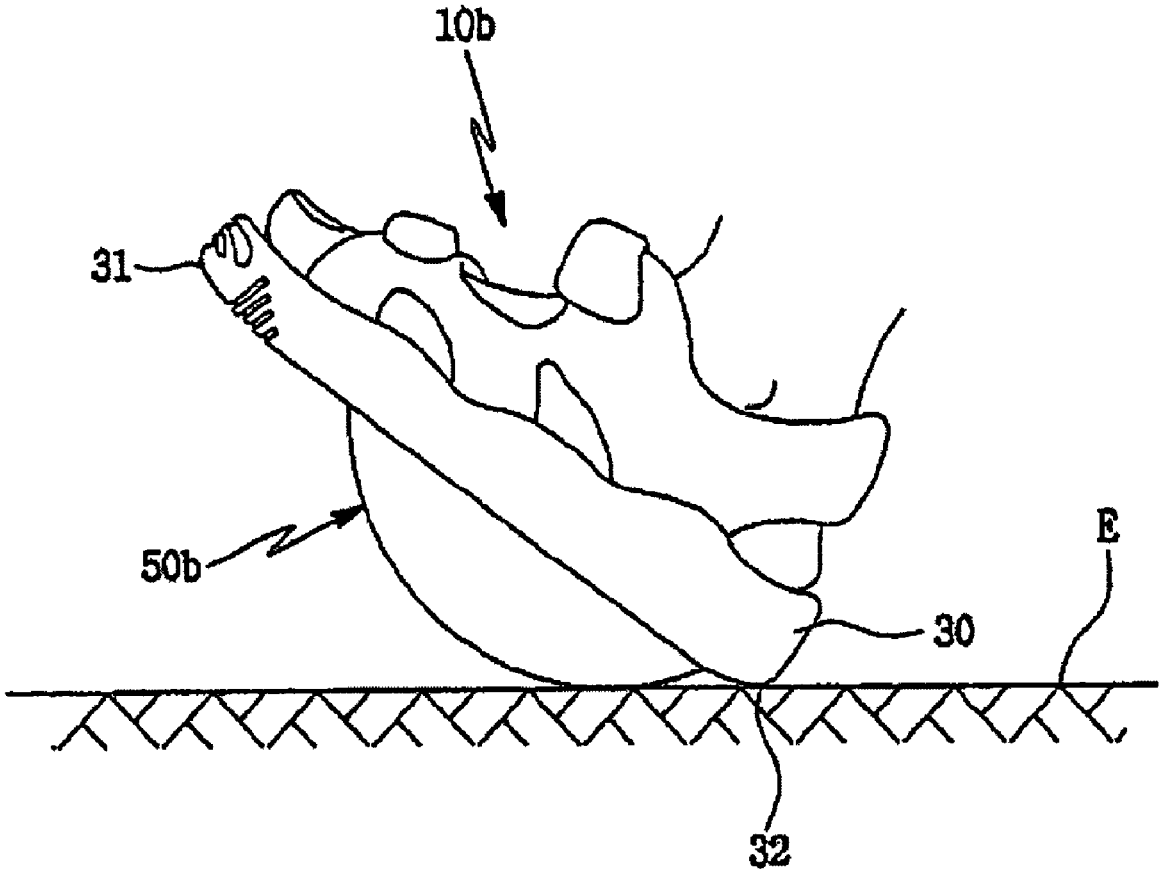
FIGS. 6 A and 6B are views illustrating the operation status of FIG. 4 A and FIG. 4B.
Figure 6B:
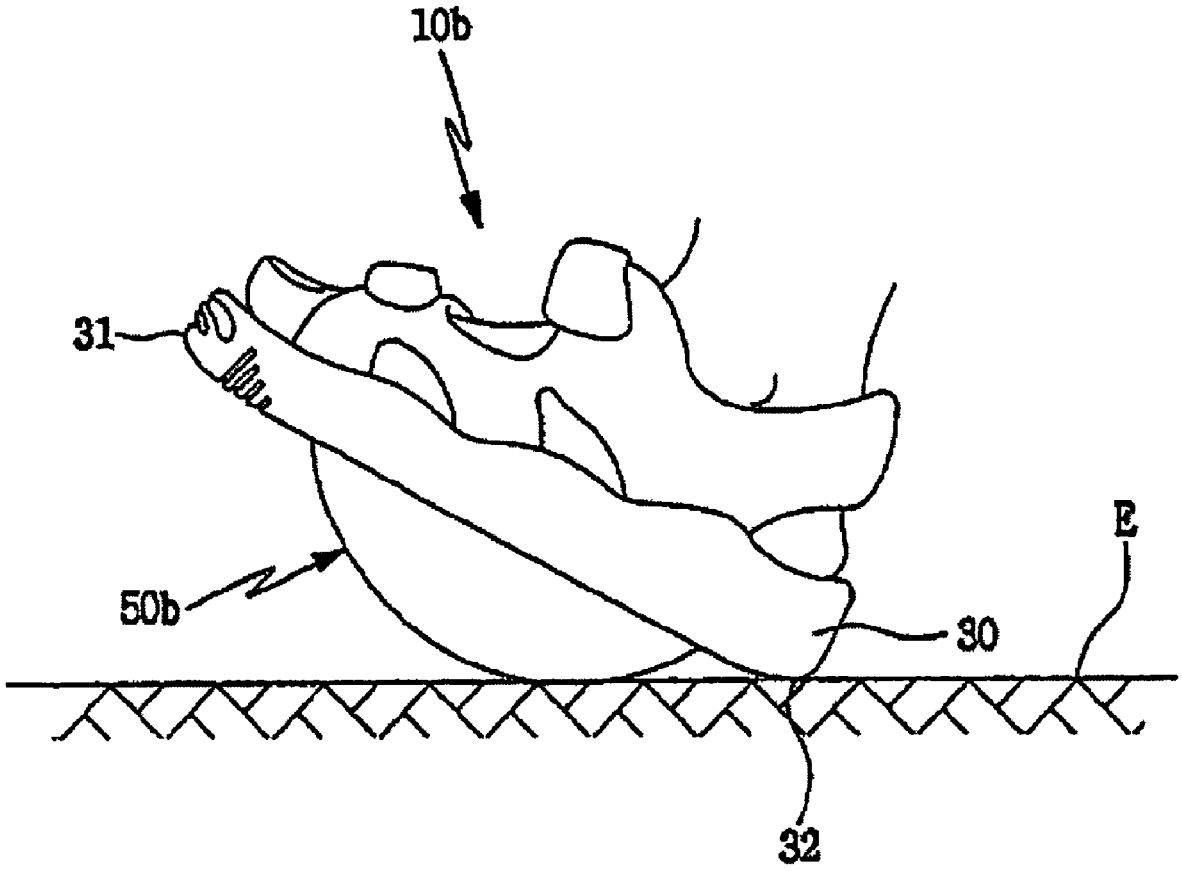

As the result of the above, in case that the arc type stretching body 50*b* is slightly bent backward at the shoe sole 30 as shown in FIG. 6 A, as the inclined angle of the backward extension posture is improved, the strength of the stretching exercise can be improved, in case that the arc type stretching body 50*b* is moved forward at the shoe sole 30 as show in FIG. 6*b*, as the inclined angle of the backward extension posture is decreased, the strength of the stretching exercise can be reduced Accordingly, the user may have a free choice with various sporting effects.

Figure 7:
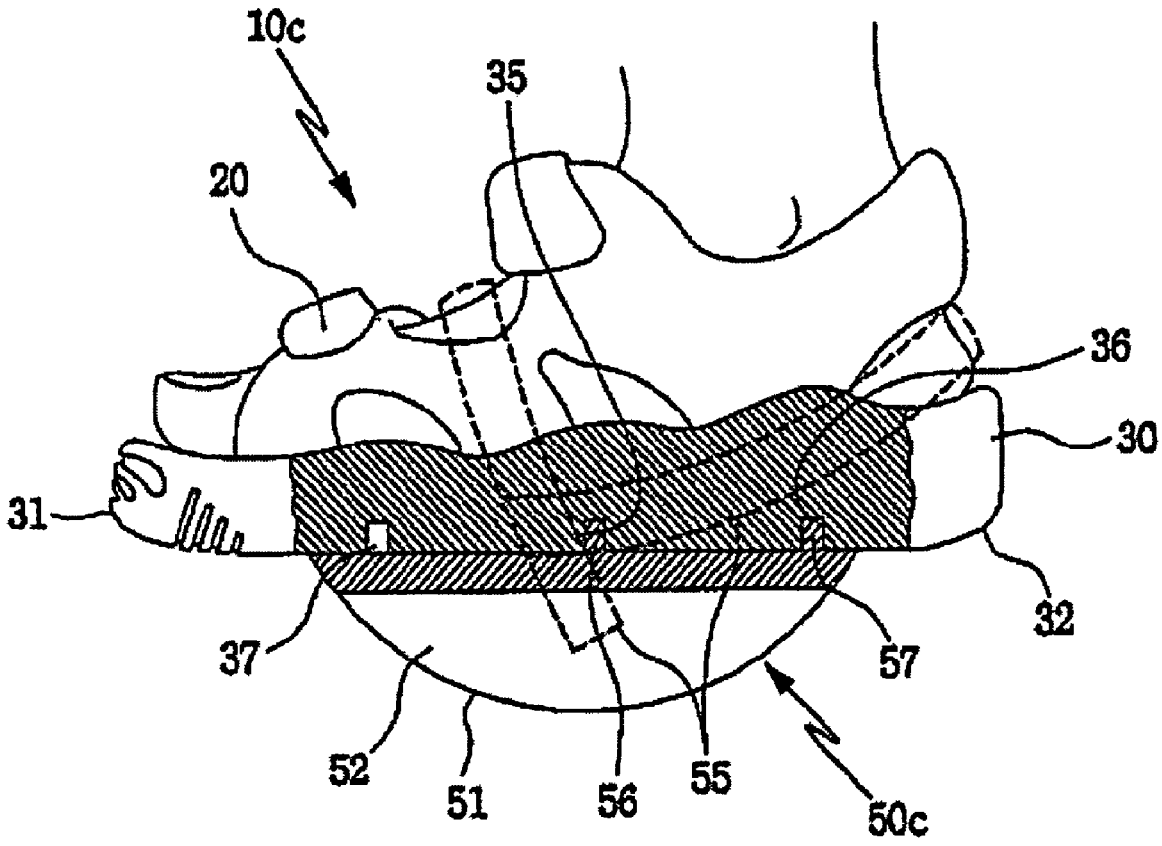
FIG. 7 is a partially cut side view of the health shoe according to a modified embodiment of the second exemplary embodiment of the present invention.

Referring to FIG. 7 illustrating a health shoe 10*c* according to a modified embodiment of the second exemplary embodiment, a band member 55 such as a velcro fastener is installed in an arc type stretching body 50*c* to allow an arc type stretching body 50*c* which can be attached to or detached from the shoe.

Accordingly, the shoe 20 can be easily changed between two modes at any time to function either as an ordinary shoe 20 suitable for walking or as a shoe 20 suitable for doing stretching exercises by attaching the art type stretching body 50*c* to the shoe by the band member 55.

An eccentric pin 56 and a position determination pin 57 are installed at an upper part of the arc type stretching body 50*c* and an eccentric groove 35 and position determination grooves 36, 37 are formed at the shoe sole 30.

The arc type stretching body 50*c* is rotated around the eccentric pin 56 as much as the eccentric length in response to 180° rotation of the arc type stretching body 50*c*, so that the position of the arc type stretching body 50*c* may be moved forward and backward at the shoe sole 30. The position of the arc type stretching body 50*c* is determined when, the position determination pin 57 is located at the position determination groove 36 or 37, so that the arc type stretching body 50*c* is not rotated.

It is noted that operation effects of the health shoe 10*c* are equal to the description provided previously with respect to operation effects of FIG. 6A and FIG. 6*b*. Accordingly, descriptions with respect to the operations effects of the health shoe 10*c* will not be repeated herein.

Figure 8A:
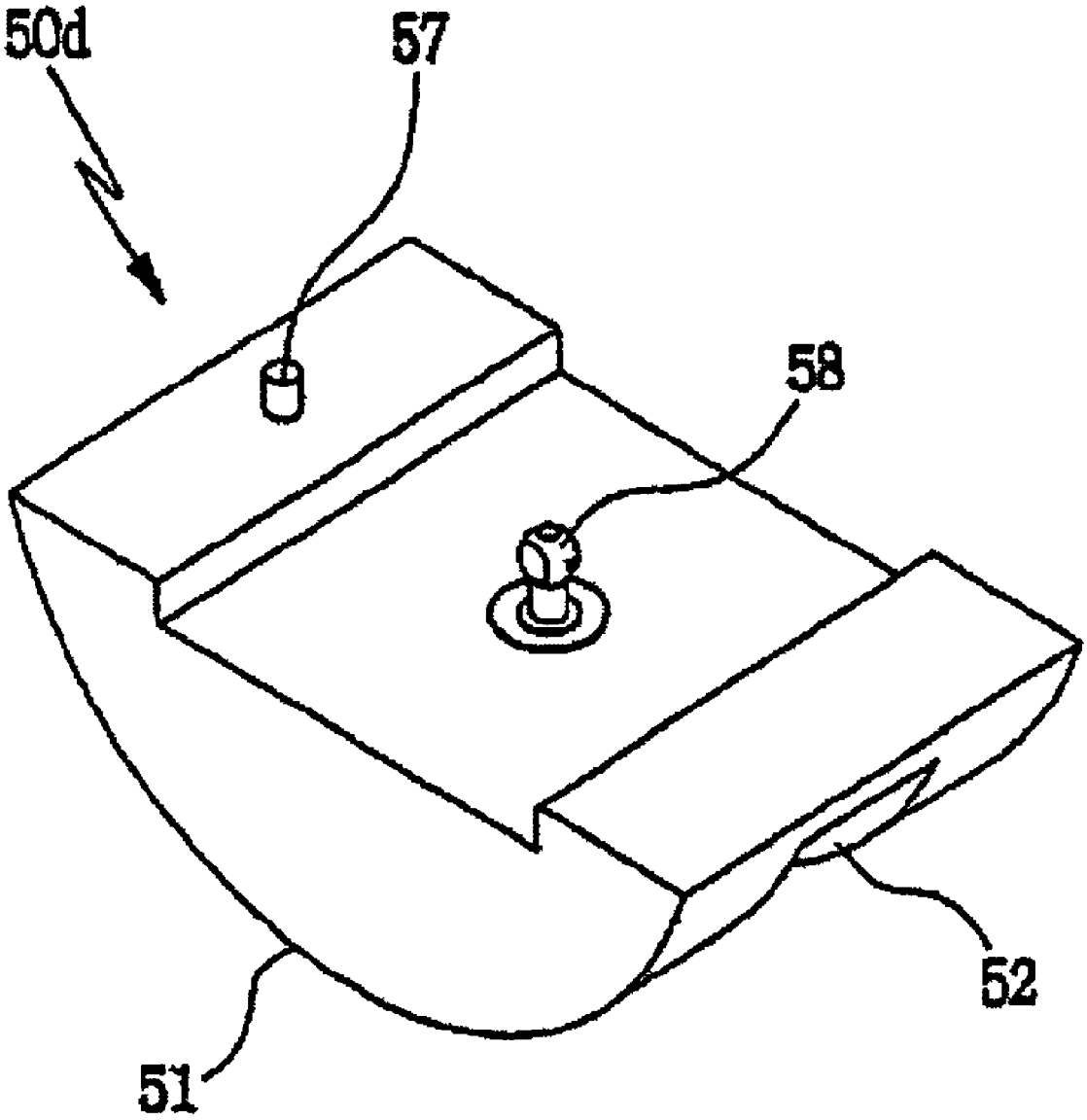
FIGS. 8A and 8B are perspective and partially cut side views of the health shoe according to other modified embodiment of the second exemplary embodiment of the present invention.
Figure 8B:
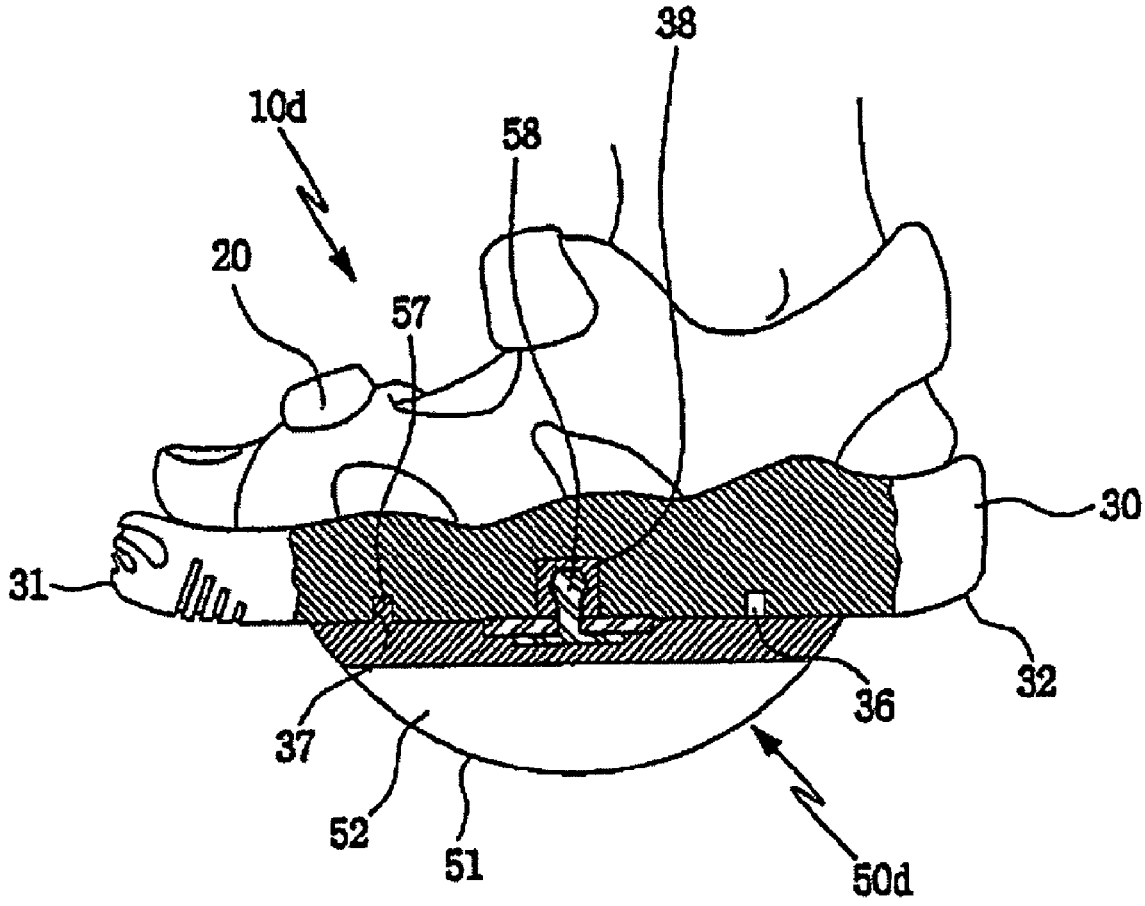

Referring to FIGS. 8*a* and 8B illustrating a health shoe 10*d* according to other modified embodiment of the second exemplary embodiment, a ball joint 58 is installed at the eccentric position from the center of the upper part of an arc type stretching body 50*d*, a position determination pin 57 is installed at one side of the arc type stretching body 50*d*, and a ball socket 38 corresponding to the ball joint and position determination grooves 36, 37 corresponding to the position determination pin 57 are formed at the shoe sole 30, respectively.

The ball joint 58 may be attachable to and detachable from the ball socket 38, so the arc type stretching body 50*d* can be separated from the shoe sole 30. Thus, it may be used either as an ordinary shoe 20 suitable for walking or as a shoe 20 suitable for doing stretching exercises by attaching the art type stretching body 50*d* to the shoe, The arc type stretching body 50*d* is rotated around the ball joint 58 as much as the eccentric length in response to 180° rotation of the arc type stretching body 50*d*, so that the position of the arc type stretching body 50*d* may be moved forward or backward at the shoe sole 30. The arc type stretching body 50*d*, in which the position thereof is determined by the position determination pin 57, is no longer rotated.

It is noted that operation effects of the health shoe 10*d* are equal to the description provided previously with respect to operation effects of FIG. 6A and FIG. 6*b*. Accordingly, descriptions with respect to the operations effects of the health shoe 10*d* will not be repeated herein.

Figure 9A:
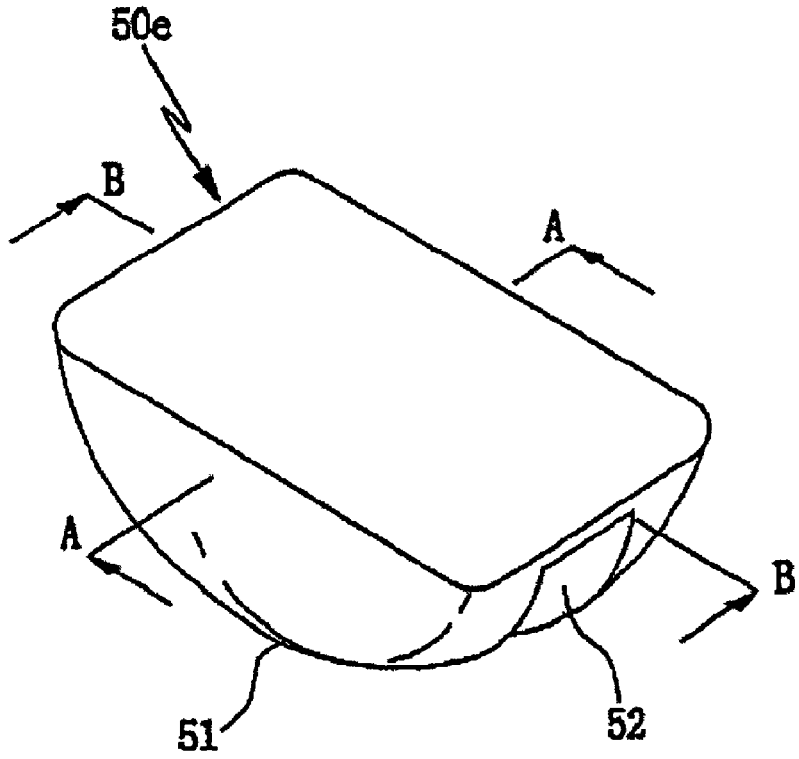
FIG. 9A is a view illustrating a modified embodiment of the arc type stretching body of the present invention.
Figure 9B:
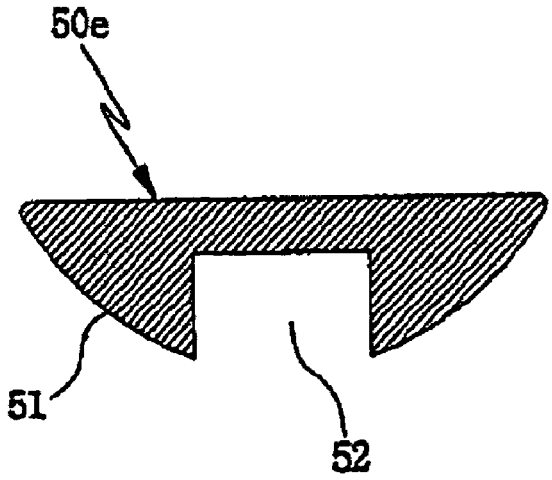
FIG. 9B is a sectional view taken along a line A-A of FIG. 9A
Figure 9C:
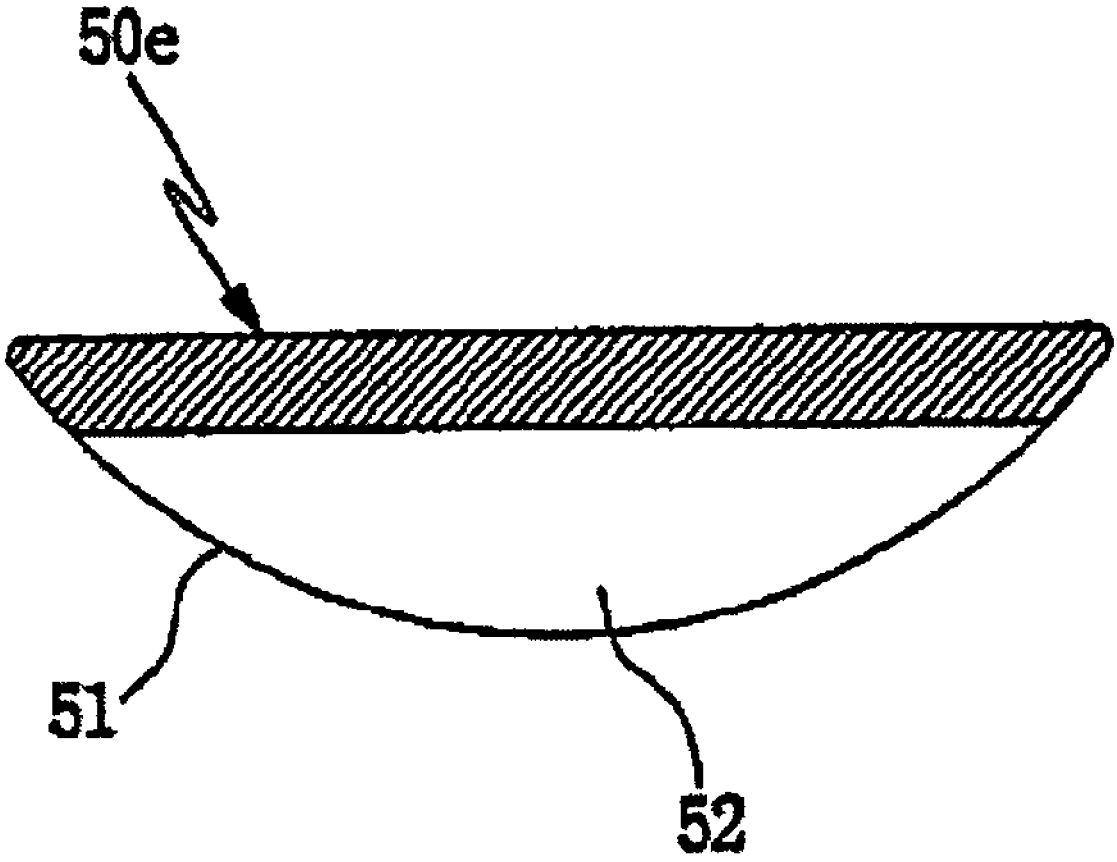
FIG. 9C is a sectional view taken along a line B-B.

Referring to FIG. 9A, FIG. 9B and FIG. 9C which are modified exemplary embodiments of an arc type stretching body 50*e* according to the present invention, the circumference 51 of the lower part thereof is formed in a radial arc type.

Accordingly, when doing the stretching exercises, the user can do exercise for the right and left ankle joint in forward flexion and backward extension postures as shown in FIGS. 3A and 3B.

The arc type stretching body 50*e* may be integrally formed with the shoe sole 30 as shown in FIG. 1 of the first exemplary embodiment and also installed at the shoe sole so as to be detachable from the shoe 20 at the shoe sole 30.

Figure 10:
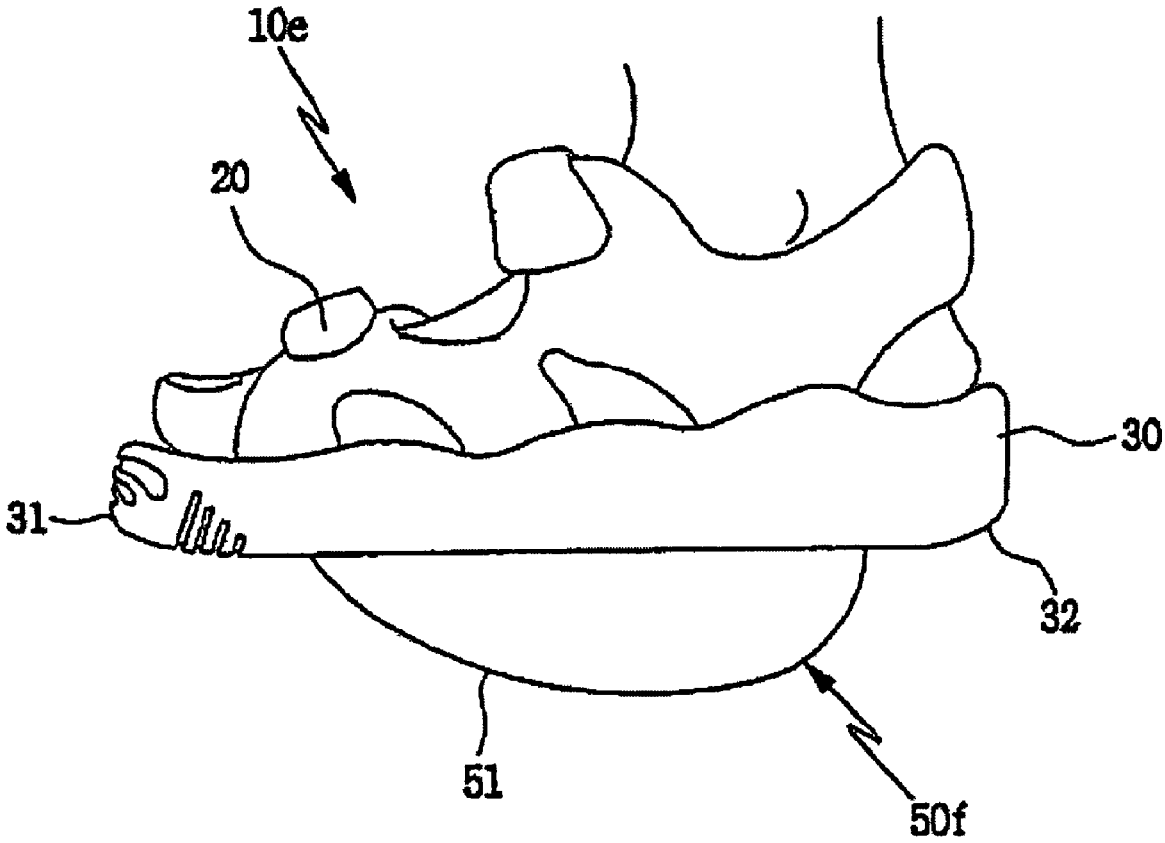
FIG. 10 is a side view illustrating another modified embodiment of the second exemplary embodiment of the present invention.

FIG. 10 shows a health shoe 10*e* according to another modified embodiment of the second exemplary embodiment. The circumference 51 of the lower part of the arc type stretching body 50*a*~50*e* is formed in symmetric arc type as show in FIG. 1 to FIG. 9C, whereas, in the modified embodiment, an arc type stretching body 10*f*, in which the circumference of the lower part thereof is asymmetrically formed in the arc type in the length direction of a shoe 20, is integrally formed with the shoe sole 30.

In the arc type stretching body 5 of as constructed above, the front side thereof is formed by a slowly curved surface and the back side thereof is formed by the curved surface which is more sudden than front side, so that ankle angles to be bent may vary with forward flexion and backward extension postures and the amount of sports may be different with each other in these postures.

Figure 11:
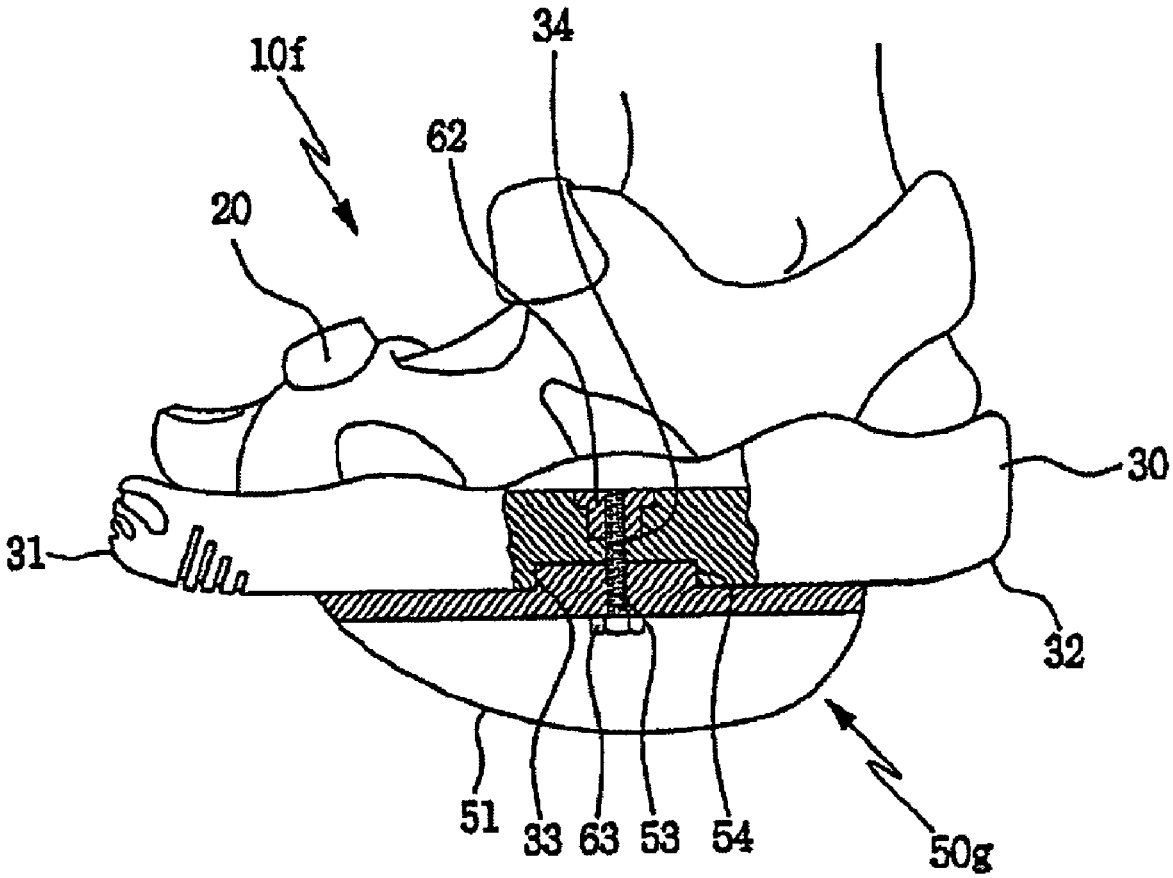
FIG. 11 is a partially cut side view of the health shoe according to another modified embodiment of the second exemplary embodiment of the present invention.

FIG. 11 shows a health shoe 10*f* according to another embodiment of the second exemplary embodiment. An arc type stretching body 50*g*, in which the circumference 51 along the lower part thereof is symmetrically formed in the arc type along the length direction of the shoe 20, is configured so as to be detachable from and rotatable around the shoe sloe 30.

An eccentric ball 53 is formed at the arc type stretching body 50*g*, a circle guide platform threshold 54 is formed around the eccentric ball 53, a circle guide groove 33 corresponding to the circle guide platform threshold 54 is formed at the shoe sole and a nut 62 and a joint ball 34 are inserted into the center of the circle guide groove 33, so that the arc type stretching body 50*g* may be separated from shoe sloe 30 by joint means of a bolt.

Figure 12:
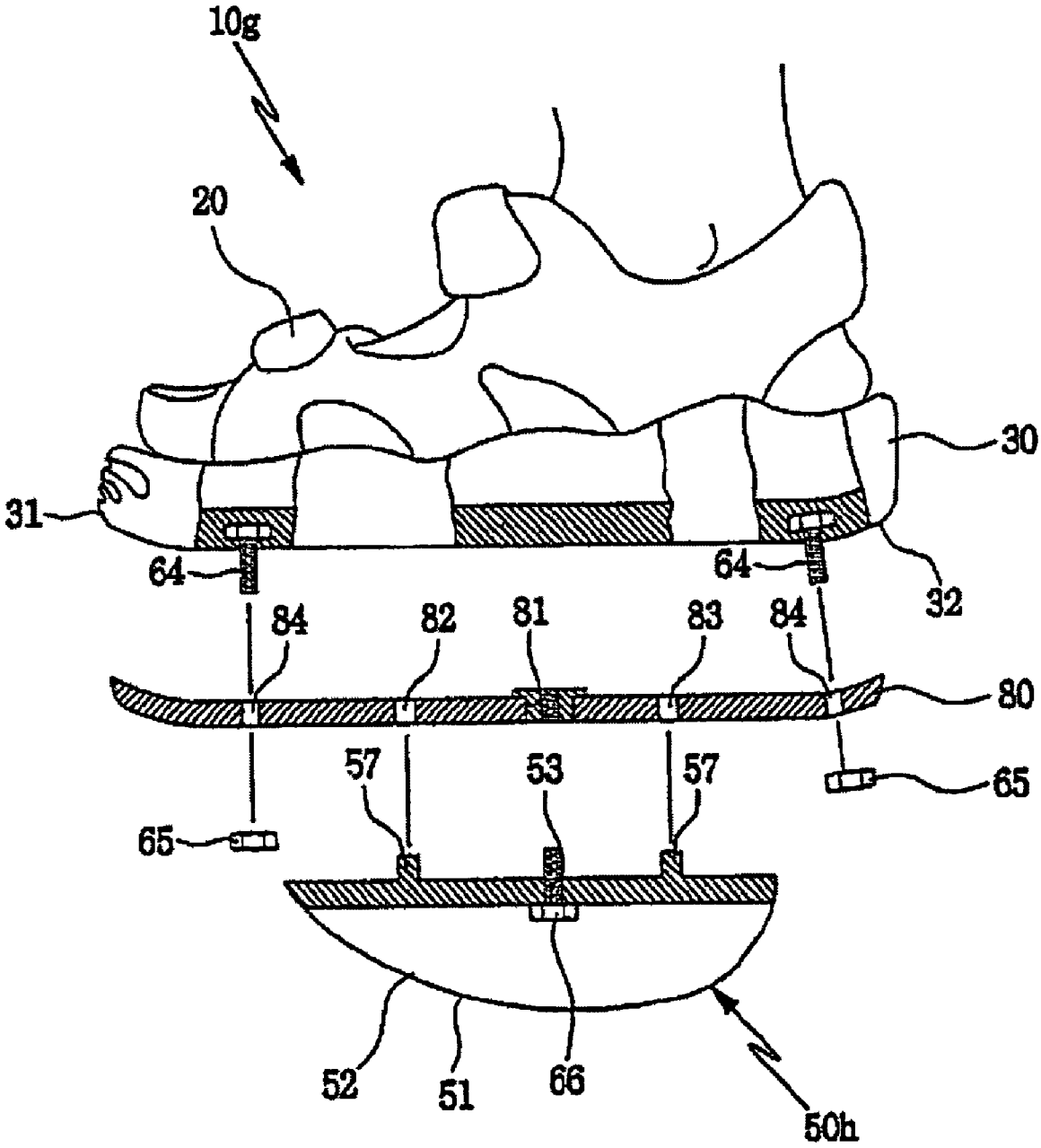
FIG. 12 is a side view illustrating the separated health shoe according to another modified embodiment modified of the second exemplary embodiment of the present invention.

FIG. 12 shows a health shoe 10*g* according to another modified embodiment of the second exemplary embodiment. A bolt 64 is installed at the both sides of a shoe sole 30, a nut 65 is inserted thereto, a connection board 80, in which position determination holes 82, 83 and joint balls 84 are formed, is placed below the shoe sole 30 and is then fixed by jointing the nut 65 into the bolt 64. An eccentric ball 53 is formed at an arc type stretching body 50*h* and the position determination pin 57 is formed at the both side thereof, thereby jointing a bolt 66 through the eccentric ball 53.

In the arc type stretching body 50*h*, the circumference thereof is asymmetrically formed in the arc type along the length direction of the shoe 20 as shown in FIG. 10 and FIG. 11.

Figure 13A:
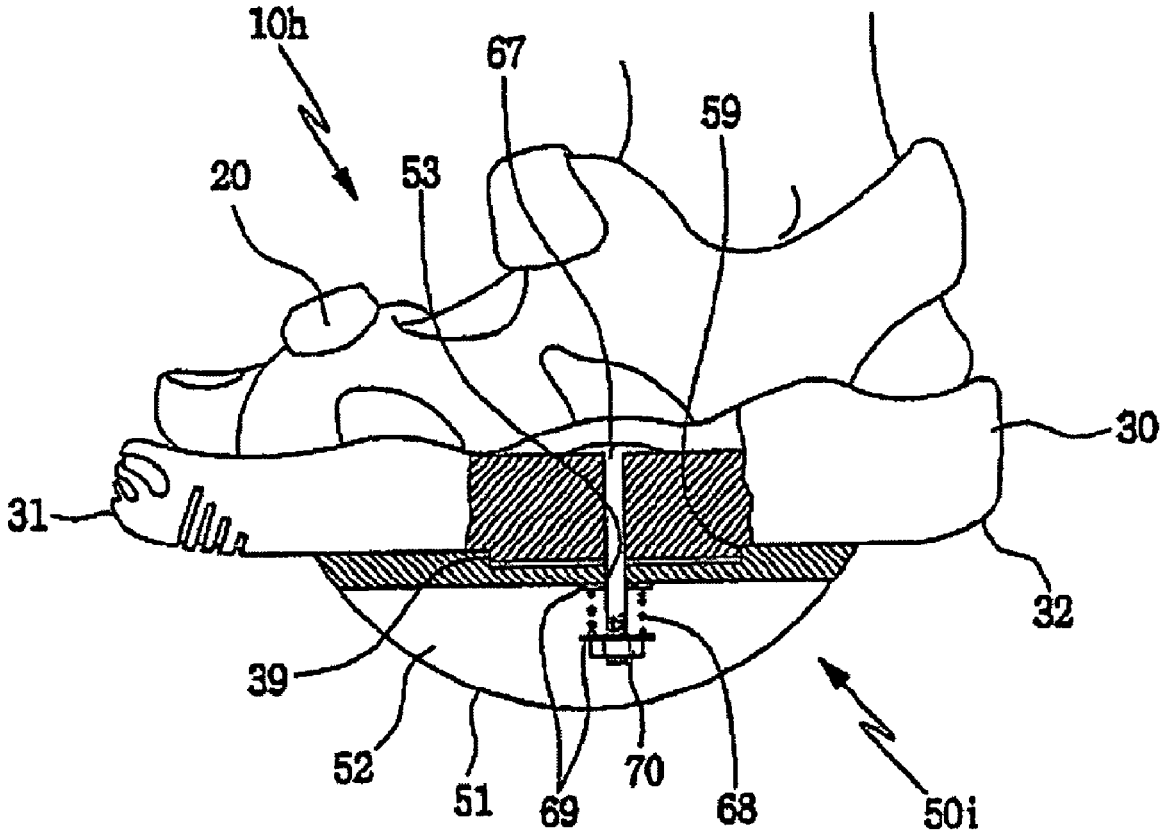
FIGS. 13A and 13B are partially cut side views of the health shoe according to another modified embodiment of the second exemplary embodiment of the present invention.
Figure 13B:
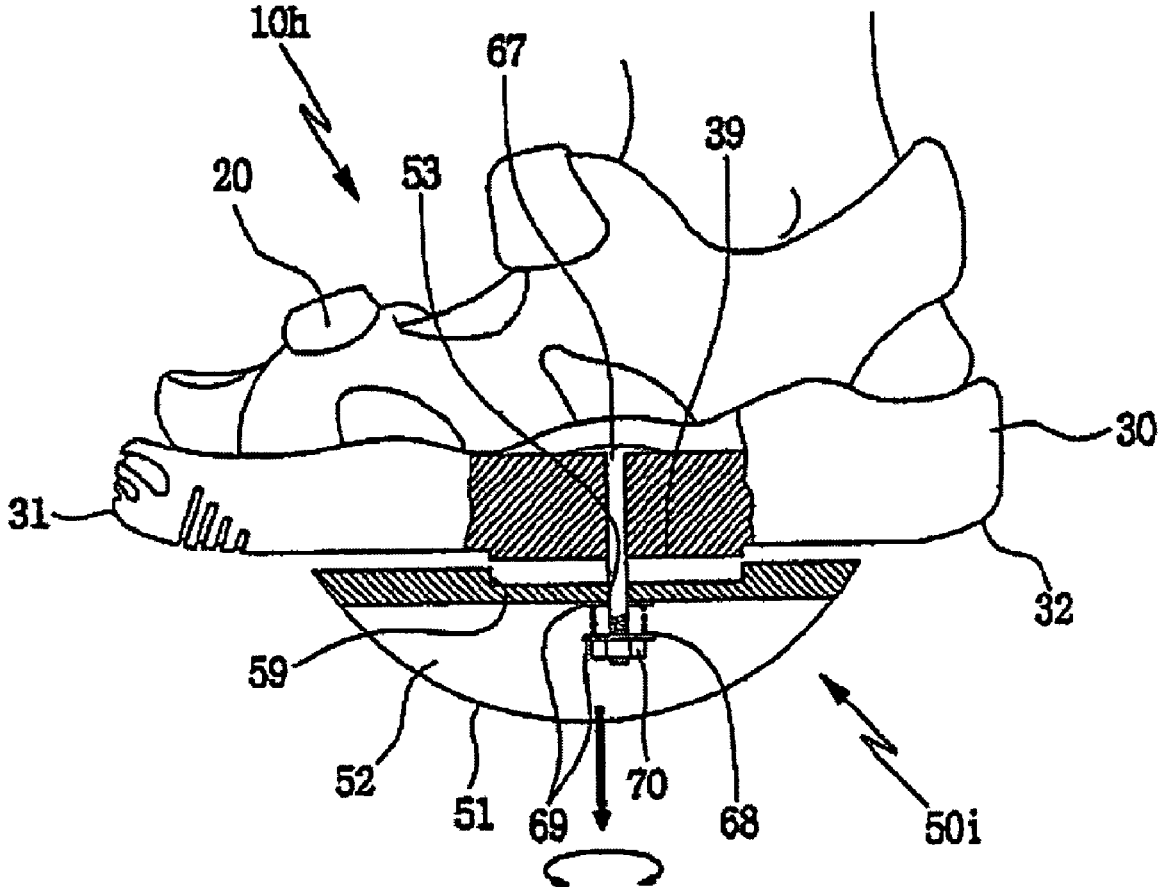

FIG. 13A and FIG. 13B show a health shoe 10*h* according to another modified embodiment of the second exemplary embodiment. An eccentric ball 53 is formed at an arc type stretching body 50*i*, a circle guide groove 59 is formed around an eccentric ball 53, a circle guide platform threshold 39 corresponding to the circle guide groove 59 is formed at a shoe sole 30, a bolt 67 along with a joint ball 34 are installed in the center of the circle guide platform 39, a spring 68 and a washer 69 are intervened between the lower parts of the bolt 67 and the nut 70 is jointed.

For rotating the arc stretching body 50*i* through 180 degree at the status as shown in FIG. 13*a*, when grasping the arc type stretching body 50*i* by hand and pulling down it in an arrow direction as shown in FIG. 13*b*, the spring 68 is compressed and the circle guide groove 59 is apart from the circle guide platform-threshold 37, subsequently if releasing the hand after rotating the arc stretching body 50*i*, the compressed spring 68 is returned to the former position by repulsive power and the circle guide groove 59 is also returned to the circle guide platform threshold 37 as the status in FIG. 13 A, so that the position of the arc type stretching body 50*i* in response to 180° rotation of the arc type stretching body 50*i* may be easily moved.

A position determination pin may be naturally formed at the arc type stretching body 50*i* as shown in previous other exemplary embodiments to correctly move and fix the arc type stretching body 50*i* rotated through 180 degree.

Figure 14:
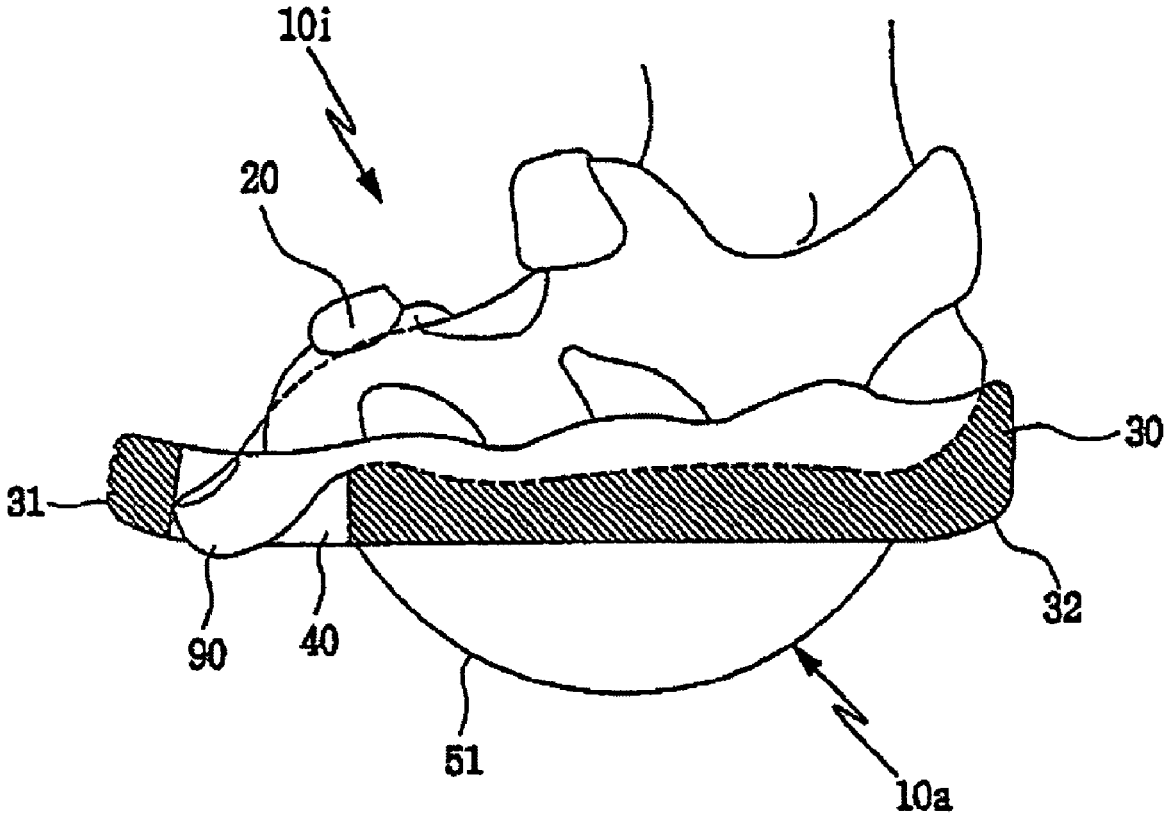
FIG. 14 is a partially cut-away side view of the health shoe according to a third exemplary embodiment of the present invention.

FIG. 14 is a health shoe 10*i* according to a third exemplary embodiment. A toe exercise guide hole 40 is punched toward the front side of a shoe sole 30 to do toe flexion and extension exercises.

The toe exercise guide hole 40 having a space for receiving five toes is used for toe exercises, so that the user can do stretching exercises through the arc type stretching body 50*a* and toe exercises through the toe exercise guide hoe 40 at the same time.

The arc type stretching body 50*a* may be integrally formed with the shoe sole as shown in FIG. 1 or may be separated from the shoe sole as shown in the second exemplary embodiment.

It is noted that operation effects of the health shoes 10*e*, 10*f*, 10*g*, 10*h* and 10*i* are equal to the description provided previously with respect to operation effects of FIG. 10, FIG. 11, FIG. 12, FIG. 13*a* and FIG. 14. Accordingly, descriptions with respect to the operations effects of the health shoe 10*e*, 10*f*, 10*g*, 10*h* and 10*i* will not be repeated herein.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

INDUSTRIAL APPLICABILITY

The present invention is to provide a health shoe which can improve stretching exercise effects in a stable posture because an arc type stretching body is supported by the front end or the rear end of the shoe sole in contact with the ground when doing exercises to relieve the tension in the Achilles tendon and the clay muscle.

What is claimed is:

1. A health shoe comprising;

an arc type stretching body which is spaced apart from a front end and a rear end of a shoe sole with a predetermined distance and is formed to be detachable from and rotatable around the shoe sole, wherein a circumference of a lower part of the arc type stretching body is formed in an arc type along a length direction of a shoe, thereby being supported by the front end and the rear end of the shoe sloe when doing forward flexion and backward extension postures through the arc type stretching body, wherein the arc type stretching body is connected with the shoe sole by an attachment, the attachment being spaced apart from a center of the arc type stretching body by a distance such that the center of the arc type stretching body is moved forward and backward as much as the distance at the shoe sole when the arc type stretching body is rotated through 180 degrees at the shoe sol, wherein the health shoe further comprising:

an eccentric ball formed at the arc type stretching body;

a circle guide platform threshold formed around the eccentric ball at the arc type stretching body;

a circular guide groove formed at the shoe sole corresponding to the circle guide platform threshold; and a joint ball formed at a center of the circular guide groove, the art type stretching body being attached to or detached from the shoe sole by a mechanism of the joint ball.

2. The health shoe as claimed in claim 1, wherein the circumference of the lower part of the arc type stretching body is formed in a radial arc type.

3. The health shoe as claimed in claim 1, wherein a band member is installed at the arc type stretching body, so that the arc type stretching body is attached to and separated from the shoe through the band member.

4. The health shoe as claimed in claim 1, wherein a toe exercise guide hole for doing toe flexion and extension exercises is formed toward the front side of the shoe sole.

5. The health shoe as claimed in claim 1, wherein the circumference of the rounded surface of the lower part of the arc type stretching body is composed of at least one of symmetry and asymmetry.

6. The health shoe as claimed in claim 3, wherein the arc type stretching body is fixed by a position determination pin at a position determination groove of the shoe sole.

* * * * *